US006680707B2

(12) United States Patent
Allen et al.

(10) Patent No.: US 6,680,707 B2
(45) Date of Patent: Jan. 20, 2004

(54) GARMENT ANTENNA

(75) Inventors: Juliette Allen, London (GB); Peter J. Massey, Horley (GB); Nancy A. Tilbury, London (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/043,524

(22) Filed: Jan. 11, 2002

(65) Prior Publication Data

US 2002/0089458 A1 Jul. 11, 2002

(30) Foreign Application Priority Data

Jan. 11, 2001 (GB) ..... 0100775

(51) Int. Cl.[7] ..... H01Q 1/12; H01Q 1/38
(52) U.S. Cl. ..... 343/718; 343/700 MS
(58) Field of Search ..... 343/718, 700 MS, 343/897; 455/99, 100

(56) References Cited

U.S. PATENT DOCUMENTS 2,576,128 A * 11/1951 Lense ..... 343/718
3,112,447 A * 11/1963 Davis ..... 455/99
3,523,296 A * 8/1970 Vliegenthardt ..... 343/718
4,689,611 A * 8/1987 Franklin ..... 340/539
6,259,399 B1 * 7/2001 Krasner ..... 342/357.06
6,356,238 B1 * 3/2002 Gainor et al. ..... 343/718
6,377,216 B1 * 4/2002 Cheadle et al. ..... 343/700 MS
6,433,743 B1 * 8/2002 Massey et al. ..... 343/700 MS
6,483,469 B2 * 11/2002 Boyle ..... 343/718

FOREIGN PATENT DOCUMENTS

DE 19843237 5/2000 ..... A41D/1/00
SE 9401831-4 1/1996 ..... H01Q/1/27

* cited by examiner

*Primary Examiner*—Tan Ho

(57) ABSTRACT

An antenna is set in an antenna mounting of size and shape such that the antenna may be accommodated at least in part in the naturally occurring dip between a persons shoulder blades at the upper part of the back. The mounting includes supporting straps which extend during use from that part of the mounting hosting the antenna, over the shoulders of the wearer and down the front of the wearers torso. The antenna mounting is provided in a garment (not shown) suitable for wearing about the upper part of the body. By extending the support straps over the wearers shoulders in this way, the weight of the straps serves to counter balance the weight of the antenna and mounting to provide more even weight distribution of the antenna and mounting combined between the front and back of the wearer, so as to be centered about the wearers shoulders. Such weight distribution seeks to improve the comfort of a garment provided with the antenna and mounting and will generally contribute to the correct 'hang' of the garment itself. In one arrangement the antenna is a fabric patch antenna.

13 Claims, 4 Drawing Sheets

GARMENT ANTENNA

TECHNICAL FIELD

The present invention relates to antennas for allowing portable electronic devices to perform wireless transfer of data and in particular, to such antennas incorporated into a garment shaped to be worn about the upper body of a user.

BACKGROUND AND SUMMARY

Traditionally, mobile telecommunications equipment including mobile telephones and radio receivers have been provided with their own antenna to form a self contained functional device. More recently, work in the field of wearable electronics has included attempts to combine and integrate electronic equipment, including telecommunications equipment with items of clothing. Such integration can be beneficial in a number of ways including improved ease of carrying electronic equipment, improved functionality and elimination of duplicated components. An example where the last two benefits are realised would be the automatic routing and switching of audio from audio reproduction equipment and a mobile telephone through the same pair of earphones.

In some instances the ability to distribute and integrate equipment in clothing allows for new types of component to be employed which can result in improved performance. An example new component is an antenna of laminar construction such as the one described in International patent application WO-A-01/39326 published on May 31, 2001 claiming priority from British patent application number 9927842.6 (applicants reference PHB 34417) filed on Nov. 26, 1999 in the name of Koninklijke Philips Electronics N.V. entitled 'Improved Fabric Antenna'. The antenna is primarily intended for use with mobile telecommunications applications and comprises first and second spaced layers of electrically conducting fabric, a layer of electrically insulating fabric between the first and second layers, first connection means by which electrical contact is made between the first and second layers, and second connection means by which the first and second layers are connectable to telecommunications equipment. The arrangement constitutes a so-called 'planar inverted F antenna (PIFA)'.

That antenna is intended for incorporation into a shoulder portion of a garment in the form of a shoulder pad or into a lapel of a garment. However, such an arrangement is not always an option. This may be due to aesthetic reasons, in particular when the garment has no arm portions at all, or no lapel. In the case of garments provided with detachable arm portions, the presence of the arm portion attachment fastenings (such as zips) may rule out the possibility of accommodating a shoulder pad antenna as the antenna can easily get in the way of, or foul correct operation of, the fastening device. There is a need to include an antenna in a garment in an ergonomic and practical way.

It is an object of the present invention to provide an antenna that may be accommodated within a garment, which device seeks to overcome at least some of the above mentioned problems.

In accordance with a first aspect of the present invention there is provided a garment comprising an antenna and means for connection of the same to a portable electronic device to permit wireless communications of said device via said antenna;

characterised in that the garment is shaped to be worn about the upper body of the user and the antenna is supported by an antenna mounting of the garment so that when the garment is being worn the antenna is held in the vicinity of the back between the shoulder blades and the antenna mounting is configured with a shape and size to accommodate the antenna in the vicinity of the back between the shoulder blades.

Such positioning of the antenna takes advantage of the naturally occurring dip between a persons shoulder blades to accommodate at least some of the thickness of the antenna while the garment is being worn. This helps to suppress any apparent bulge in the garment caused by the presence of the antenna.

The antenna mounting may include a body portion configured with a shape and size such that it is capable of being at least partially accommodated in the vicinity of a wearers back between their shoulder blades.

The antenna mounting may include straps which extend during use over the shoulders of a wearer towards the front of the wearers torso. In this case the straps may be configured to extend during use at the front of the wearers torso to at least partially counterbalance the weight of the antenna. By incorporating this arrangement of antenna and antenna mounting in a garment the weight of the antenna is more evenly distributed over the garment and therefore contributes to the users comfort while they are wearing the garment having the antenna.

The antenna may be removed from the garment prior to washing of the garment.

The antenna mounting may be removed from the garment prior to washing of the garment.

In accordance with a second aspect of the present invention there is provided an antenna suitable for use in a garment made in accordance with the first aspect of the present invention.

These and other aspects of the present invention appear in the appended claims which are incorporated herein by reference and to which the reader is now referred.

BRIEF DESCRIPTION OF THE DRAWING FIGURES

The present invention will now be described with reference to the Figures of the accompanying drawings in which.

Figure 3A:
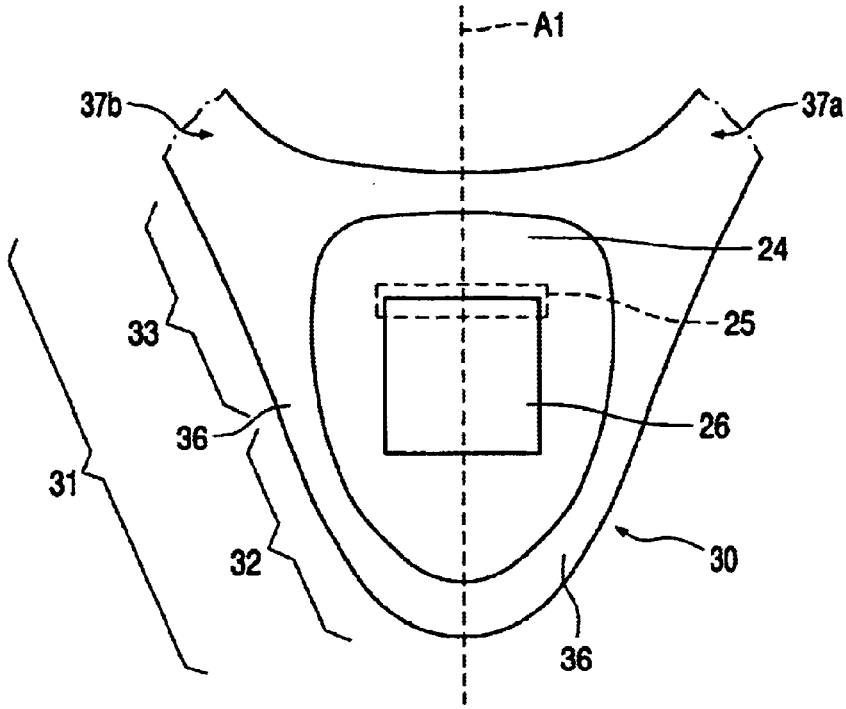
Figure 3B:
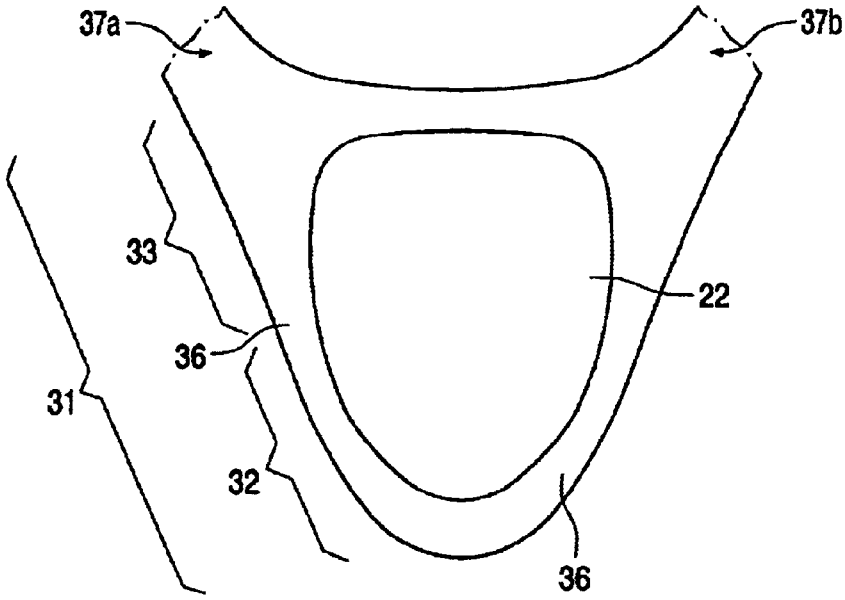
Figure 4:
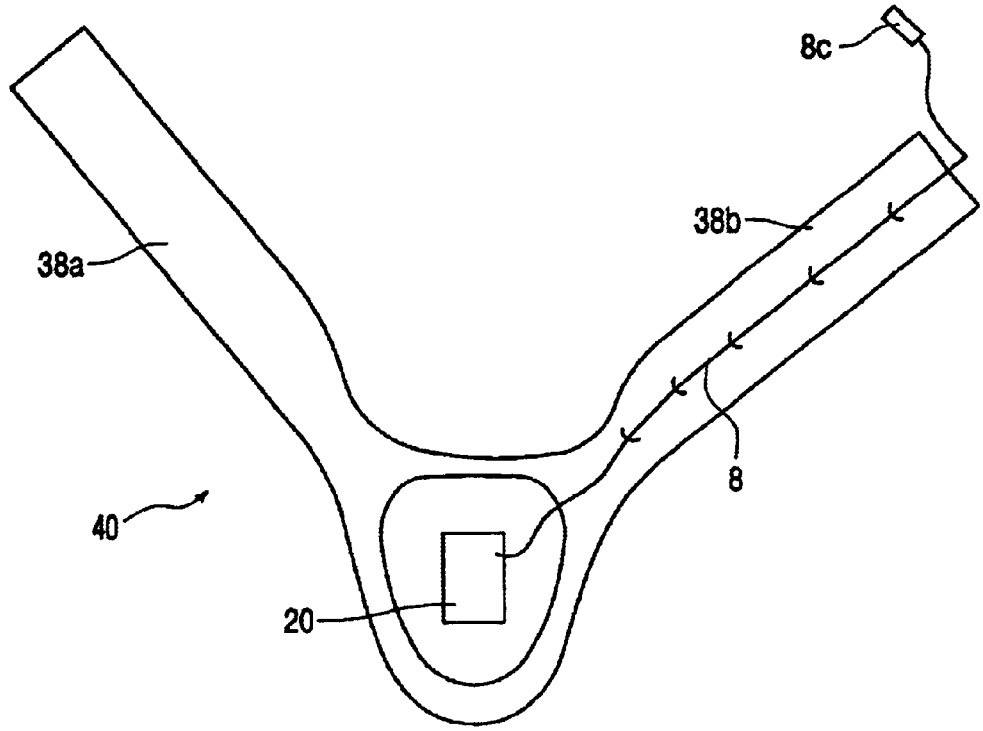
Figure 6:
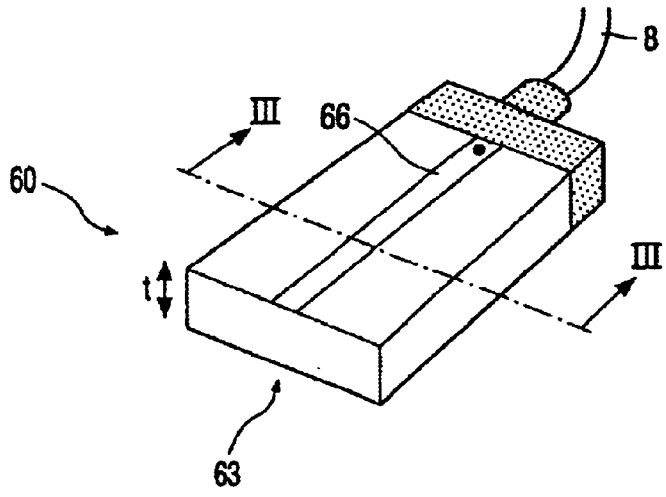
Figure 5A:
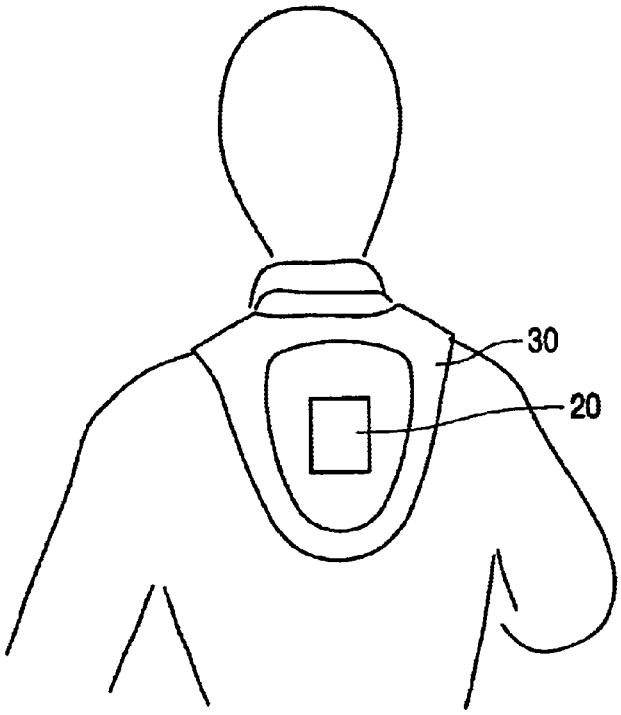
Figure 5B:
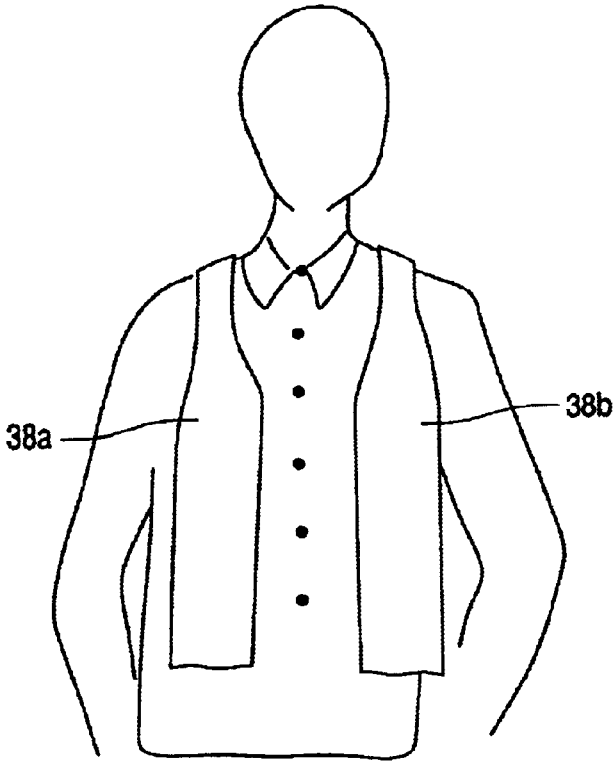

FIG. 3*a* shows a front view of the patch antenna and part of an antenna mounting;

FIG. 3*b* shows a rear view of the patch antenna and part of an antenna mounting;

FIG. 4 shows an antenna mounting carrying the patch antenna;

FIG. 5*a* shows the patch antenna and antenna mounting arranged on a wearer and viewed from a first perspective;

FIG. 5*b* shows the patch antenna and antenna mounting arranged on a wearer and viewed from a second perspective; and FIG. 6 is a perspective view of a device for connecting an RF feed cable to a patch antenna.

It should be noted that the drawings are diagrammatic and not drawn to scale. Relative dimensions and proportions of parts of the Figures have been shown exaggerated or reduced in size for the sake of clarity and convenience in the drawings. The same reference signs are generally used to refer to corresponding or similar features in the different embodiments.

DETAILED DESCRIPTION

Figure 1:
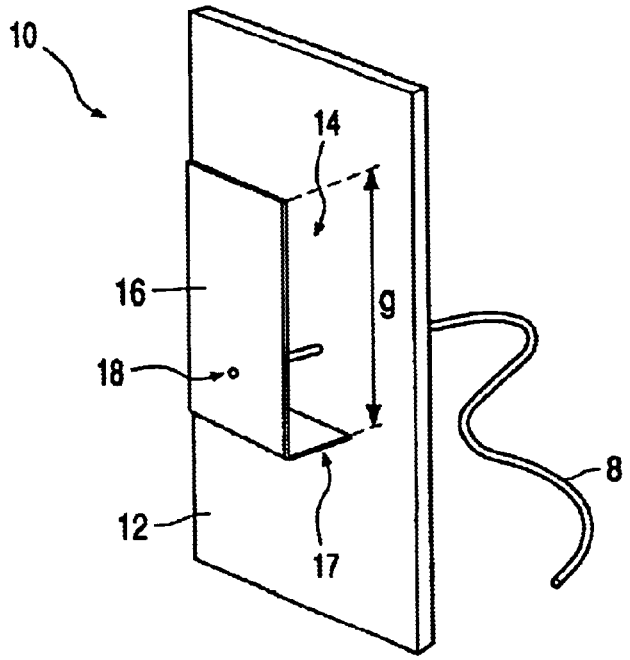
FIG. 1 is shows the principle functional components of a planar inverted F antenna.

Referring to FIG. 1, the principle components of a planar inverted F antenna (PIFA) comprise a first conducting ground plane 12, a second conducting plane 16 and a bridging portion 17 extending between the first plane 12 and second plane 16. The bridging portion 17 provides an electrical short between the first conducting ground plane 12 and second plane 16. As can be seen from FIG. 1, the second conducting plane 16 and bridging portion 17 form an inverted 'L' section. A co-axial radio frequency (RF) feed cable 8 has inner conductor 8*a* connected to the second conducting plane 16 at location 18 and the co-axial cable 8 has outer conductor 18*b* connected to the first (ground) plane 12. The first and second plane 12, 16 are separated by a dielectric 14, which is shown here as an air gap. In essence the PIFA is a low profile resonant element which is about quarter of a wavelength long, in this case shown by dimension 'g'. When operating, currents oscillate in the inverted L section. The antennas impedance is determined by where the feed is connected in the 'g' direction along the 'L' section, and the impedance is lowered by connecting the feed nearer the short, that is nearer to the bridging portion 17.

Figure 2:
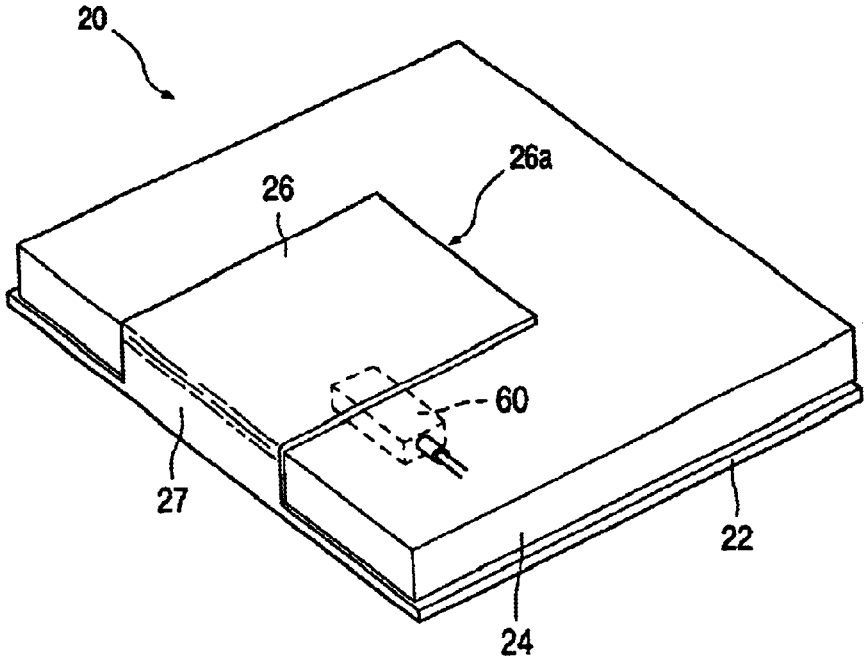
FIG. 2 is a perspective view of a patch antenna constructed to function as a planar inverted F antenna.

Such an antenna may be built as a laminar construction 20 as shown in FIG. 2. The antenna is provided with lower layer of conducting fabric 22 to form the ground plane, on top of which is mounted one or more layer of insulating material 24 serving as the antenna dielectric, and positioned on the insulating material 24 is an upper layer 26 of conducting fabric which is approximately rectangular in shape and generally smaller in area than the lower layer 22. The upper and lower layers are connected by a neck portion 27 of conducting fabric. The upper layer 26 and neck portion 27 form the inverted 'L' section which faces the ground plane 22. Hence this construction forms a planar inverted F antenna, which is also known as a quarter wavelength patch antenna. The lower layer 22 and upper layer 26 are formed of a single piece of fabric which is folded back on itself at neck portion 27. It is not essential that the lower layer, upper layer and neck portion 22, 26, 27 are of the same piece of fabric and they may be formed of two or more pieces of fabric attached to one another. When separate pieces of fabric are indeed employed, the lower and upper layers, 22, 26, may be shaped separately and electrical connection established by sewing them together with electrically conductive thread, or by conductive gluing, or by sewing the conductive layers together using a seam which places them in pressurised contact.

An important requirement is that irrespective of how many portions of conductive fabric are used to make up the upper and lower layers, the ground plane (lower layer 22) should be of a larger area than the second plane (upper layer 26).

The components used in the antenna construction may be held together by thread, glue or other suitable methods.

A material suitable for providing the layers of conducting fabric is a woven nylon plated with a layer of copper or silver or nickel; the material known as "Shieldex" (Trade Mark) is suitable. The fabric is electrolessly plated. Electroless plating is a technique where the metal is deposited from solution directly onto the (chemically cleaned) material surface, which process gives a good mechanical bond in comparison with some other known electroplating techniques. As no resistive seed layers are involved during the deposition process, there is also improved radio frequency connectivity. Electrolessly plated rip-stop nylon was found to have excellent conductivity and seems to be quite resistant to the onset of deterioration that may be caused by normal use and laundry wash cycles. For the insulating layers, materials typically used in the garment construction industry are suitable, such as acrylic, horse hair, cotton, polyester, wool and tailor's foam. Since the antenna can be of not insignificant area and will be mounted in a garment, it is advantageous that it is breathable and lightweight. Such requirements lead to one favoured insulating material being open cell foam.

The antenna 20 will normally be positioned in a garment such that the ground plane (lower layer 22) is adjacent the wearer in comparison with the upper layer 26. This is because the lower layer 22 is provided as the ground plane of the antenna 20, and the relative shapes of the layers are such that the ground plane extends substantially beyond the principle radiating edge 26*a* of the upper layer 26, so as to isolate the wearer from the strongest electromagnetic fields radiated from the antenna. In addition, the amount of signal absorbed by the wearer is reduced.

It will be understood that the antenna 20 can be flexed in use to conform to the shape of the garment it is accommodated within while the garment is being worn. The ability to flex seeks to minimise any awareness that the wearer may have of the presence of the antenna in the garment and therefore will not give rise to discomfort. The antenna will therefore be comfortable in use, whilst remaining fully operative even while being flexed.

The antenna 20 is supported by an antenna mounting 30. Part of the front side of the antenna mounting 30 is shown in FIG. 3*a* while the corresponding rear side part of this mounting is shown in FIG. 3*b*. As may be seen from those Figures, the mounting 30 comprises a body portion 31 which is generally symmetrical about a central vertical axis denoted A1 but tapered to be narrower towards a lower section 32 than an upper section 33. Such tapering contributes towards the body portion 31 of the antenna mounting 30 having a shape and size which is capable of being accommodated at least in part in the naturally occurring dip between a persons shoulder blades at the upper part of the back. A body portion 31 of suitable size and shape for incorporation into an adults jacket will have an overall height (comprising upper section 33 and lower section 32) of around 20 centimeters. The overall thickness of the body portion 31 (incorporating the antenna) will be in the order of 1 cm to 1.5 cm.

The insulating material 24 forming the antenna dielectric is of open cell foam which contains a slit denoted in FIG. 3*a* by broken line 25 and exaggerated in size for clarity. The upper and lower conductive layers 26, 22 respectively are of electrolessly plated rip-stop nylon with the neck portion 27 passing through slit 25. The open cell foam extends to perimeter portions 36 of the mounting 30 where it is attached by suitable means, such as by thread. As may be seen in FIG. 3*b*, the lower layer 22 forming the ground plane also extends to the perimeter portions 36 of the mounting 30 where it is attached by any suitable means, such as by thread. In those cases where the chosen garment construction method dictates that the lower layer 22 is too small to form a ground plane of sufficient area, an extra conductive layer may be provided adjacent to and in electrical contact with the lower layer 22 which extends to the perimeter portions 36 of the mounting 30.

Extending from upper adjacent corners 37*a*, 37*b* of the body portion 31 are support straps 38*a*, 38*b*. The body portion 31 and support straps 38*a*, 38*b* together form an antenna mounting resembling a 'yoke' arrangement 40 which may be attached to a garment to provide a means for mounting the antenna in a garment. While a garment including the yoke-type antenna mounting is being worn, the arrangement of the yoke-type antenna mounting is illustrated in FIGS. 5*a* and 5*b* (the garment itself is not shown for the sake of clarity). FIG. 5*a* shows a person from behind and the antenna 20 and body portion 31 are located in the vicinity of the wearers back between the shoulder blades. FIG. 5*b* shows a person from the front and the support straps 38*a*, 38*b* are shown to extend from the body portion 31, over the shoulders of the wearer and down the front of the wearers torso. By extending the support straps in this way, their weight serves to counter balance the weight of the antenna 20 and body portion 31 to provide more even weight distribution of the antenna 20 and antenna mounting combined between the front and back of the wearer and centered on the wearers shoulders. Such weight distribution seeks to improve the comfort of a supporting mounting and will generally contribute to the correct 'hang' of the garment itself. Straps 38*a*, 38*b* will be typically 80 cm long for a yoke-type antenna mounting intended for fitting to an adult sized jacket although the length may be altered accordingly to obtain the correct weight distribution and to be suitable for incorporation in the garment. The yoke-type antenna mounting may be of any suitable flexible material, in particular a fabric, for example nylon. In the configuration shown, the antenna mounting has straps 38 and perimeter portions 36 of the body portion 31 are made from CORDURA®, with the perimeter portions containing polyester filling or polyurethane foam. FIG. 4 shows the co-axial feed cable 8 attached to one of the support straps 38*a* or 38*b* by loops of thread. The feed cable 8 terminates with connector 8*c* for connecting the antenna to telecommunications equipment. If desired, the antenna mounting may carry electronics as well as the antenna.

The antenna mounting and antenna may be included in a garment permanently by building it into the lining. Alternatively the antenna mounting and antenna may be removably fastened to the garment allowing it to be removed therefrom prior to washing the garment or for use in another garment. The antenna mounting may be included in garments that may be worn about the upper part of the body, such garments including jackets or coats. The fact that the yoke type antenna mounting has straps extending from the rear and along the front of a garment while it is being worn means that the antenna mounting can be used to carry wiring and connectors for connecting together various pieces of electronic equipment that are being carried by a user, such equipment including audio reproduction devices, telecommunications equipment, microphones, earphones and user input devices and wearable computing apparatus. The materials of the antenna and antenna mounting holder are preferably chosen to be permeable to air in order to allow the parts of the users body that they cover during use to be able to 'breathe'.

The conductors of the feed cable 8 may be attached to the conductive layers of the fabric antenna by known methods such as soldering (although such a technique is not ideal) or possibly using a clamping arrangement. One preferred connection technique is to use connection device 60 illustrated in FIG. 6 which is inserted between the lower conductive layer 22 and upper conductive layer 26 of the antenna 20, with device conductive microstrip 66 in contact with antenna upper layer 26 and device lower conductive surface 63 (not shown) in contact with lower antenna conductive layer 22. This device and connection technique is the subject of co-pending British patent application number GB0100774.9 (applicants reference PHGB 010004) filed on Jan. 11, 2001 in the name of Koninklijke Philips Electronics N.V. entitled 'Connector Device', the teaching of which is incorporated herein by reference.

In general, location of an antenna around the upper regions of a wearers body is preferred because there is less chance of the antenna being obscured during use.

One example patch antenna suitable for use with GSM 900 MHz applications is a quarter wavelength PIFA which has an upper conductive layer 26 which has been made especially wide to reduce conductor losses. The patch is approximately 70 mm square. The separation of the upper and lower antenna conductive layers is around 12.5 mm. The large width and height of the antenna upper conductive layer results in the antenna being unusually inductive. This can be compensated for by a method that is described in more detail in the above mentioned co-pending British patent application number GB0100774.9 (applicants reference PHGB 010004) filed on Jan. 11, 2001 entitled 'Connector device', the teaching of which is incorporated herein by reference. It has been found that positioning the RF feed to the side of the antenna at around 20 mm from the short 27 (see FIG. 2) provides a good electrical match. The measured antenna performance showed a match across the extended GSM band of 880 to 960 MHz having better than 6 dB return loss. While the antenna is not being worn, efficiency is around 70% to 80%. This drops to around 50% when the antenna is being worn, and seems to be reasonably independent of who the user is, which is in contrast to the case where the antenna is included in a mobile telephone. However, the relatively large ground plane formed by a lower layer 22, which is ideally 10 cm or more across, contributes towards isolation of the antenna fields from the users body to reduce the energy absorbed by the user. Such a ground plane cannot normally be accommodated in a mobile telephone so in-built phone antennas will generally have lower efficiencies (due to user absorption) of only 30% to 50% at best, dropping to only 3% to 5% at worst.

While a 900 MHz antenna construction has been described in some detail it will be appreciated by the person skilled in the art that antennas may be constructed to be used at other frequencies, for example around 1800 MHz.

While the present invention has been described in the context of a patch antenna in the form of a planar inverted F antenna, it is possible to use other types of antenna such as a half wave patch antenna. Such an antenna is similar in mechanical construction to the quarter wave planar inverted F antenna but does not have the short (bridging portion 17 of FIG. 1/neck portion 27 of FIG. 2) between the first and second conductive layers of the patch antenna. Indeed it is possible that the antenna may be of an alternative type having laminar construction or even an antenna of an entirely different type, for example an induction coil, whilst still remaining within the scope of the present invention.

From reading the present disclosure, other modifications will be apparent to persons skilled in the art. Such modifications may involve other features which are already known in the design, manufacture and use of garments, antennas (including antennas of laminar construction (fabric or otherwise)) and applications thereof and which may be used instead of or in addition to features already described herein.

What is claimed is:

1. A garment comprising an antenna and means for connection of the antenna to a portable electronic device to permit wireless communications of said device via said antenna;

characterised in that the garment is shaped to be worn about the upper body of a the user and the antenna is supported by an antenna mounting of the garment so that when the garment is being worn the antenna is held entirely in the vicinity of the back of the user between the shoulder blades and the antenna mounting is configured with a shape and size to accommodate the antenna in the vicinity of the back between the shoulder blades.

2. The garment of claim 1 wherein the antenna mounting includes a body portion configured with a shape and size such that it is capable of being at least partially accommodated in the vicinity of the back of the user between the shoulder blades.

3. The garment of claim 1 wherein the antenna mounting includes straps which extend during use over the shoulders of a wearer towards the front of a torso of the user.

4. The garment of claim 3 wherein the straps are configured to extend during use at the front of the torso to at least partially counterbalance the weight of the antenna.

5. The garment of claim 1 wherein the antenna is a patch antenna device.

6. The garment of claim 5 wherein the antenna includes first and second spaced layers of electrically conducting material; a layer of electrically insulating material between the first and second layers; and connection means by which the first and second layers are connectable to telecommunications equipment.

7. The garment of claim 6 wherein the antenna includes further connection means by which electrical contact is made between the first and second layers.

8. The garment of claim 6 in which the layer of electrically conducting material adjacent a wearer of the garment is of substantially greater area than the area of the other layer of electrically conducting material and is connected as an antenna ground plane.

9. The garment of claim 6 wherein the first or second layer or both of the first and second layer of conducting material is a fabric.

10. The garment of claim 9 wherein the fabric is electrolessly plated rip stop nylon.

11. The garment of claim 6 wherein the layer of insulating material is open cell foam.

12. The garment of claim 1 wherein the antenna is removable from the garment prior to washing of the garment.

13. The garment of claim 1 wherein the antenna mounting is removable from the garment prior to washing of the garment.

* * * * *